US007529156B2

(12) United States Patent
Landsberg

(10) Patent No.: US 7,529,156 B2
(45) Date of Patent: May 5, 2009

(54) SYNCLECRON TIME KEEPING APPARATUS

(76) Inventor: Yale S. Landsberg, 1395 Stone Creek La., Apt 303, Charlottesville, VA (US) 22902

( * ) Notice: Subject to any disclaimer, the term of this patent is extended or adjusted under 35 U.S.C. 154(b) by 0 days.

(21) Appl. No.: 11/820,760

(22) Filed: Jun. 20, 2007

(65) Prior Publication Data

US 2008/0008049 A1 Jan. 10, 2008

Related U.S. Application Data

(60) Provisional application No. 60/815,521, filed on Jun. 21, 2006.

(51) Int. Cl.
*G04B 19/26* (2006.01)

(52) U.S. Cl. ..... 368/16; 368/15

(58) Field of Classification Search ..... 368/15–20
See application file for complete search history.

(56) References Cited

U.S. PATENT DOCUMENTS 5,917,778 A * 6/1999 James et al. ..... 368/17

* cited by examiner

*Primary Examiner*—Vit W Miska
*Assistant Examiner*—Sean Kayes
(74) *Attorney, Agent, or Firm*—David Aker

(57) ABSTRACT

By enabling its users to see and thus more vividly experience local solar day and local solar night, etc., the Synclecron invention seeks to somewhat alleviate the modern-day problem of human separation from the flows and ebbs of natural time. It does so via providing a way of mapping and displaying the experiential passage of solar and other day and night to conventional displays of conventional time. The Synclecron invention achieves this by two means. First by utilizing waxing & waning, journeying pairs of hieroglyph circles that alternately travel twice a day through a hieroglyph sky around a hieroglyph earth. And, last, by using a rotating "minute-hour" indicator, which displays where the Synclecron invention's user is in local natural time during each "natural" one-twelfth hour of his or her local natural day and natural night. The invention thus provides a view of passage of local solar day and night, and other solar days and nights, not only personalized to one's latitude and longitude, but also tied to one's time of local sunrise and sunset. As a consequence, the Synclecron invention more wholly informs the minds and bodies of users about the daily and nightly passages of natural time which we each experience every moment of each day and night, and which are not typically derived from most conventional timepieces.

22 Claims, 8 Drawing Sheets

A TWO-TANGENT-CIRCLES-WITHIN-AND-TANGENT-TO-AN-OUTER-CIRCLE YIN YANG-LIKE GEOMETRY

THE DISPLAY OF SOLAR DAYTIME AFTER THE TIME OF LOCAL SUNRISE AND BEFORE THE TIME OF LOCAL MID-DAY SOLAR DAY, AND AFTER THE TIME OF LOCAL SUNSET AND BEFORE THE TIME OF LOCAL SOLAR MID-NIGHT

A TWO-TANGENT-CIRCLES-WITHIN-AND-TANGENT-TO-AN-OUTER-CIRCLE YIN YANG-LIKE GEOMETRY

THE DISPLAY OF SOLAR DAYTIME AFTER THE TIME OF LOCAL SUNRISE AND BEFORE THE TIME OF LOCAL MID-DAY SOLAR DAY, AND AFTER THE TIME OF LOCAL SUNSET AND BEFORE THE TIME OF LOCAL SOLAR MID-NIGHT

DISPLAY OF SOLAR DAYTIME SOON BEFORE TIME OF LOCAL SUNSET, AND BEFORE TIME OF LOCAL BEGINNING OF NIGHT

LOCAL MID-DAY/NOON FOR OTTAWA, DEC. 22, 2006

LOCAL MIDNIGHT FOR OTTAWA, DEC. 22 - DEC. 23, 2006

LOCAL MID-DAY/NOON FOR OTTAWA, DEC. 22, 2006

LOCAL MIDNIGHT FOR OTTAWA, NIGHT OF DEC. 22 - DEC. 23, 2006

LOCAL MID-DAY/ NOON FOR OTTAWA, DEC. 22, 2006

LOCAL MID-NIGHT FOR OTTAWA. NIGHT OF DEC. 22 - 23, 2006

SYNCLECRON TIME KEEPING APPARATUS

This application claims priority, under 35 U.S.C. §119(e), from provisional patent application Ser. No. 60/815,521 filed on Jun. 21, 2006, which is hereby incorporated by reference in its entirety.

BACKGROUND OF THE SYNCLECRON INVENTION

1. Field of the Invention

The present invention, called the Synclecron, relates to apparatus, methods, etc. that correlate conventional time as displayed via digital and analog representations with both ebbing & flowing, moving hieroglyphic circles, and also with a rotating "minute-hour" indicator. The circles portray the waxing & waning, daily and nightly nature of the passage of "natural" time of day and "natural" time of night, also called "local solar day" and "local solar night". The indicator shows the current portion of each successive "natural" hour (one twelfth) of local solar day and local solar night. The Synclecron's hieroglyphs and indicator are displayed via computers and other means of representation. To represent daily local solar day cycles, a waxing and waning solar day circular hieroglyph journeys through a hieroglyphic daytime sky during the day's period of time between time of local sunrise and time of local sunset. Similarly, to represent nightly local solar night cycles, a waxing and waning solar night circular hieroglyph travels through a hieroglyphic night-time sky during that night's period of time between time of local sunset and the next day's time of local sunrise. It is believed this invention can be useful in the fields of chronobiology and chronotherapy.

2. Background Art

Since ancient times, a variety of methods have been used to show the passage of time, from archaic sundials and water-clocks and sand-filled hourglass devices to analog and today's digital watches and clocks. With the exception of sundials, such devices have generally sought to portray time in ways independent of the passage of local solar day and local solar night. Furthermore, sundials are restricted to representing the passage of the sun in the sky during sunny days. Some modern clocks display the passage of day and night via a shadow moving across the entire earth, not from a local perspective. In addition to displaying conventional standard time, the Synclecron invention displays the passage of local solar day and local solar night, and does so independent of weather conditions. And it also does so from the point of view of a given longitude and latitude location on the earth. Based on astronomical calculations, the rates of change of each day's hourly passing of local solar day and each night's hourly passing of local solar night are adjusted according to the times of local sunrise and local sunset for a given latitude and longitude location and that date. In accord with pre-modern traditions around the world, each day consists of twelve "natural" hours and each night consists of twelve "natural" hours. The definition of those "natural" hours being, respectively, one twelfth of the time between that day's time of local sunrise and local sunset, and one twelfth of the time between that night's time of local sunset and the next day's time of local sunrise.

SUMMARY OF THE SYNCLECRON INVENTION

It is an objective of the Synclecron invention to provide a scientifically accurate, mathematically precise and aesthetically pleasing multiple hieroglyphic representation and display of the passage of local solar day and local solar night for any given latitude and longitude between the polar regions. And also within the polar regions on days when the difference between the time of local successive sunrises is twenty four hours. Based on standard astronomical calculations, each day's display of the passage of local solar day and each night's display of the passage of local solar night are adjusted for each day of the year as the earth revolves around the sun.

It is also an objective of the invention to map the above hieroglyphic representations and indicator displays of the flowing & ebbing passage of local solar day and of local solar night as calculated by standard astronomical computations to values of modern standard time as displayed by conventional analog and digital timepieces.

These objectives are achieved with the Synclecron invention by utilizing a two-inner-circles-within-an-outer-circle "yin yang"-like geometry where one of the inner circles is fixed and this fixed inner circle serves as hieroglyphically representing the earth, and the other inner circle waxes and wanes and "journeys" through a hieroglyphic "sky". The changing circle first serves as the day hieroglyph representing local solar day, and then serves as the night hieroglyph representing local solar night. There is a standard dynamic geometry equation, which describes the movement of a variable inner circle that stays tangent to a fixed inner circle and also stays tangent to a fixed outer circle. In accord with that equation, said two-mode journeying hieroglyph waxes and wanes from a beginning point to an end point twice a day, that dual point being the point of tangency of the outer and inner fixed circles. The waxing and waning hieroglyph travels through the hieroglyphic sky area between the fixed inner circle and the fixed outer circle. It first does so during the course of the day cycle and then during the course of the night cycle. The timing of each flowing and ebbing and journeying is synchronized to the passage of standard time as displayed in digital or analog format. An analog or digital clock can be simultaneously displayed within the fixed inner circle or elsewhere on the invention. In all cases, the waxing and waning day and night hieroglyphs, journeying through daytime and nighttime hieroglyphic skies, are synchronized to the times of local sunrise and sunset for a given latitude and longitude on a given date. The times of local sunrise and local sunset used for these synchronizations are based on standard calculations such as are found in Peter Duffet-Smith's "Practical Astronomy With Your Computer."

BRIEF DESCRIPTION OF THE DRAWINGS

The foregoing aspects and other features of the present invention are explained in the following description, taken in connection with the accompanying drawings, wherein.

DETAILED DESCRIPTION

Figure 1:
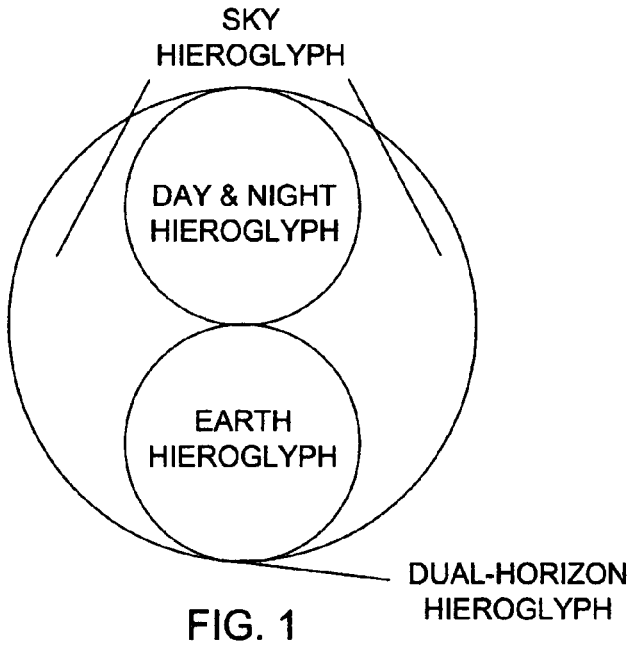
FIG. 1 is a diagram of a Synclecron display.

FIG. 1 is a diagram of the geometry of the Synclecron invention showing its two-inner-circles-within-an-outer-circle "yin yang"-like geometry with, for both the solar and lunar cycles, its day and night hieroglyph, its sky hieroglyph and its earth hieroglyph and its dual "horizon" hieroglyph.

Figure 2:
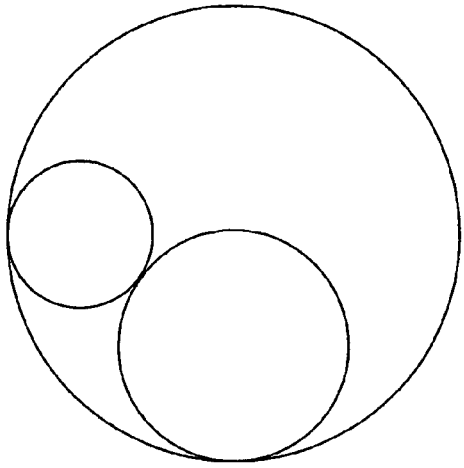
FIG. 2 is a diagram that shows the Syncleron between at a time between sunrise and noon.

FIG. 2. is a diagram that shows both the state of the local solar day hieroglyph of the Synclecron invention at a time between time of local sunrise and time of local noon, and also the state of the local solar night hieroglyph between time of local sunset and the time of local mid-night.

Figure 3:
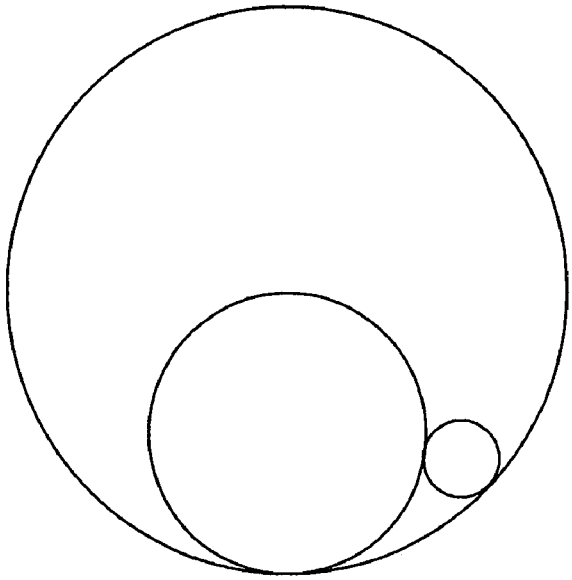
FIG. 3 is a diagram of the Syncleron at a time before sunset.

FIG. 3 is a diagram showing the state of the solar day hieroglyph of the Synclecron invention at a time soon before a day's time of local sunset and the state of the solar night hieroglyph at a time soon before local sunrise of the next local solar day.

Figure 4:
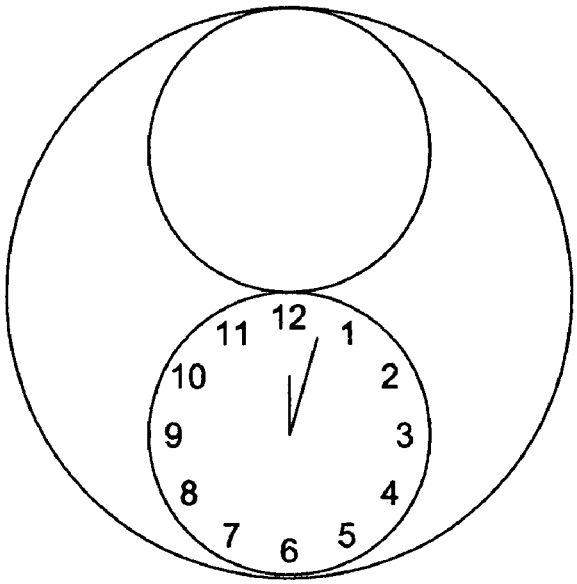
FIG. 4 is a diagram of the Syncleron at mid-day/noon.

FIG. 4 is a diagram of the Synclecron invention representing local solar mid-day/noon on Dec. 22, 2006 for Ottawa Canada, with an analog clock included for mapping the hieroglyphic passage of solar day and of solar night to the passage of conventional standard time. As Ottawa's longitude is 75 degrees 45 minutes west and its latitude is 45 degrees 16.2 minutes north, and as on that date Ottawa's times of local sunrise and sunset are respectively 7:40 am EST and 4:23 pm EST, the time of local solar mid-day/noon for Ottawa during that day, occurring by definition half-way between the local times of sunrise and sunset, is calculated and displayed as 12:02 pm.

Figure 5:
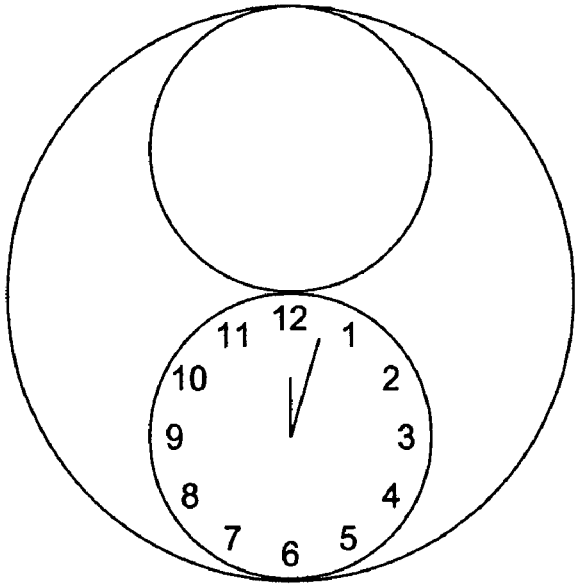
FIG. 5 is a diagram of the Syncleron at midnight.

FIG. 5 is a diagram of the invention representing local solar mid-night on the night of Dec. 22, 2006-Dec. 23, 2006 for Ottawa Canada, with an analog clock included for mapping the hieroglyphic passage of solar day and of solar night to the passage of conventional time. As Ottawa's longitude is 75 degrees 45 minutes west and its latitude is 45 degrees 16.2 minutes north, and as on Dec. 22, 2006 its time of local sunset is 4:23 PM EST, and on Dec. 23, 2006 its time of local sunrise is 7:41 am EST, the time of local solar mid-night for Ottawa during that night, occurring by definition half-way between the times of local sunset and sunrise, is calculated and displayed as 12:02 am.

Figure 6:
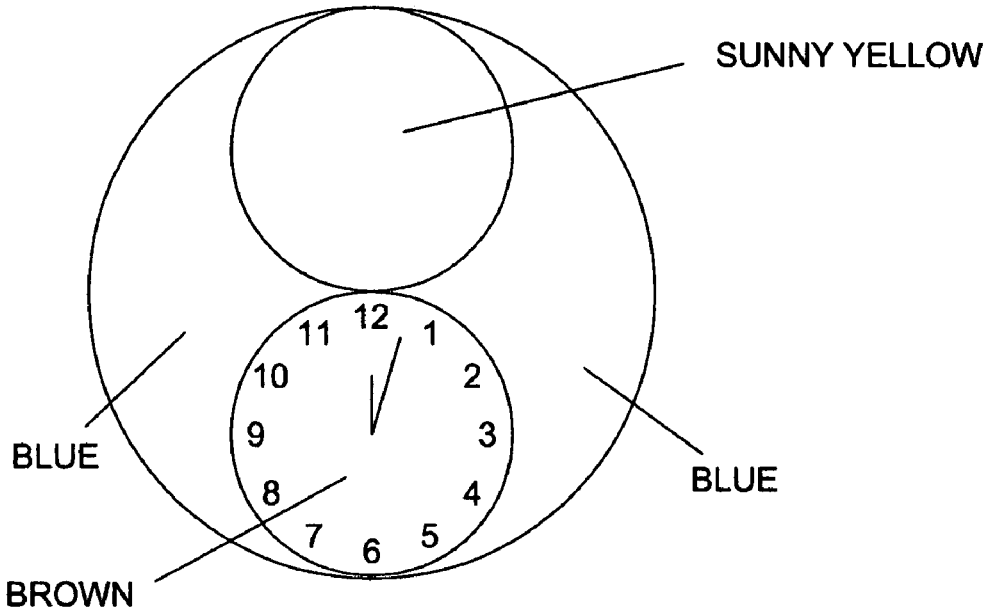
FIG. 6 is a diagram of a color Syncleron at mid-day/noon.
Figure 7:
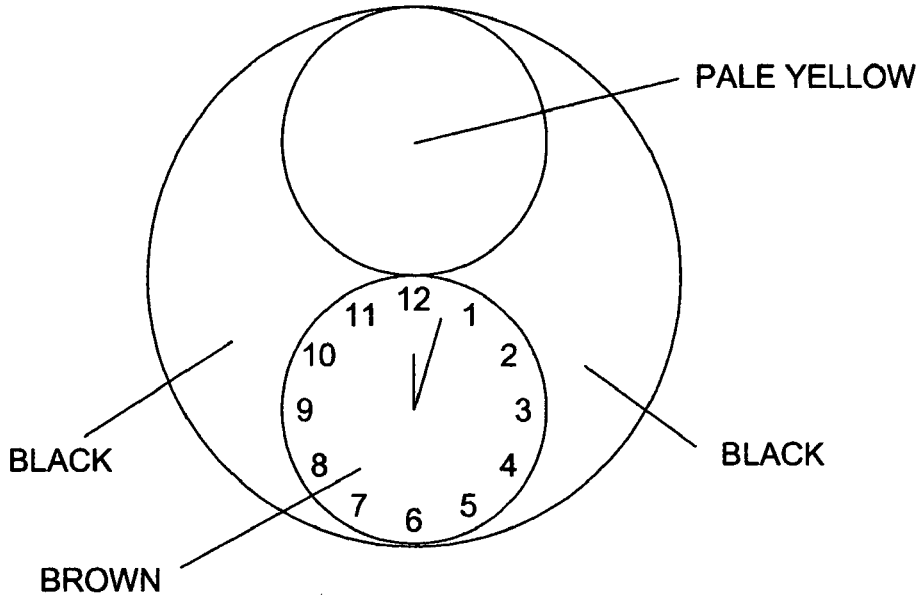
FIG. 7 is a diagram of a color Syncleron at midnight.

FIG. 6 and FIG. 7 are diagrams of embodiments of the Synclecron invention illustrated in FIG. 4 and FIG. 5 with the addition of color to more vividly display the passage of solar day and night in accord with personal experience of day and night. Similar use of color can be added for more vivid displays of passage of lunar day and night.

The colors or shades of grey in FIG. 6 are added to FIG. 4, such that the color of the fixed inner circle is an earthy brown, the solar daytime waxing and waning and journeying hieroglyph is a sunny yellow, and that of the solar daily hieroglyph sky is a sky blue. Various other colors can be used for other effects.

The colors or shades of grey of FIG. 7 are added to FIG. 5 such that the color of the fixed inner circle is an earthy brown, that of the solar nighttime waxing & waning, traveling hieroglyph is a moon-like pale yellow, and that of the solar nightly hieroglyph sky is a black as black as night. Various other colors can be used for other effects.

Figure 8:
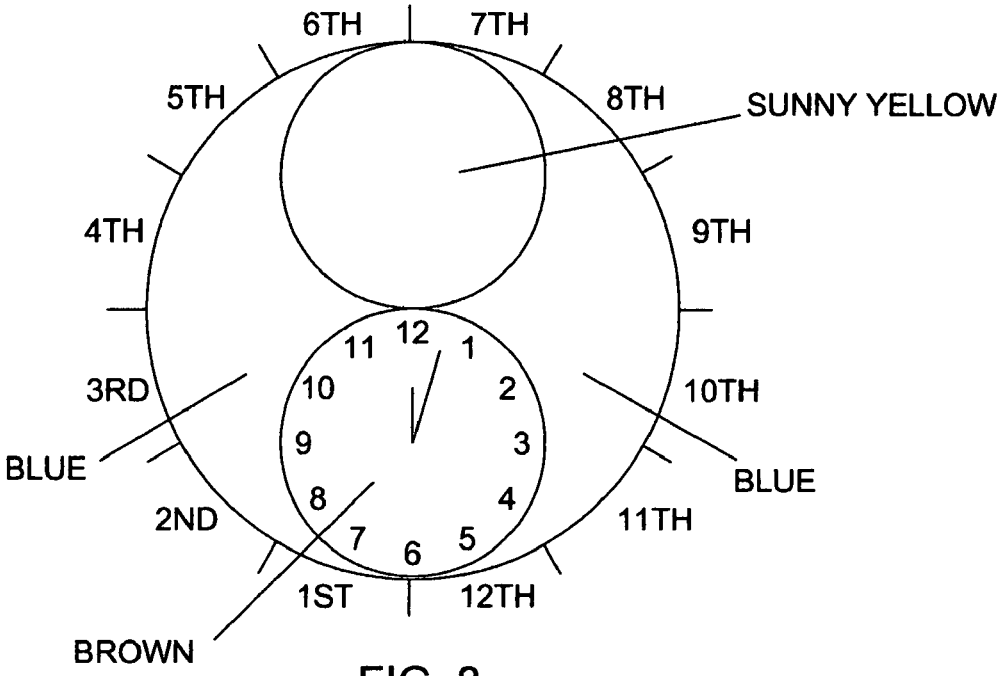
FIG. 8 is a diagram of a color Syncleron at mid-day/noon. The Syncleron has additional numerals.
Figure 9:
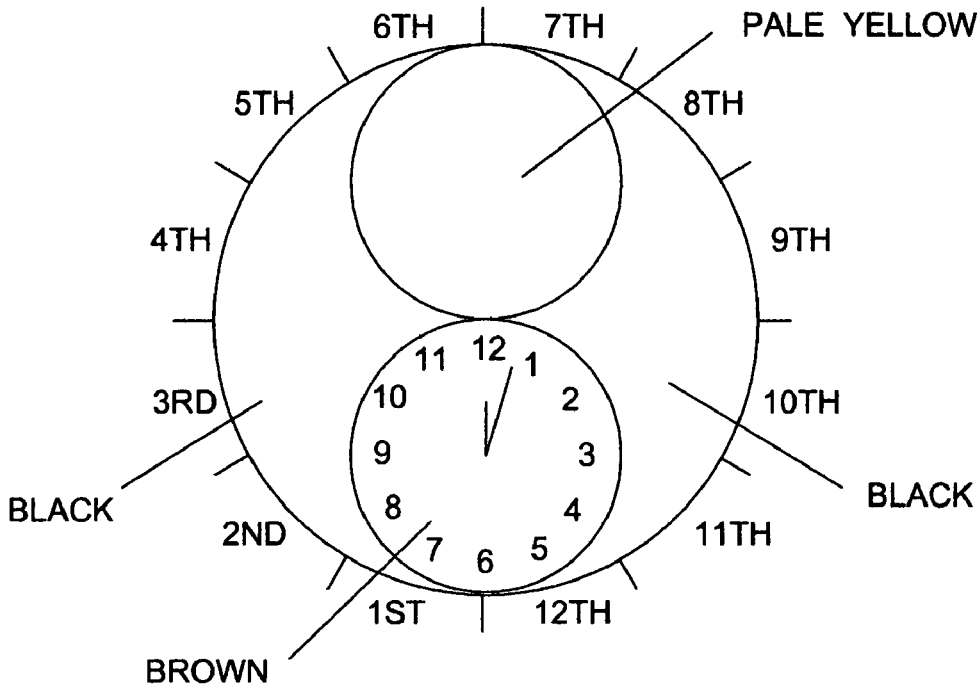
FIG. 9 is a diagram of a color Syncleron at mid-day/noon. The Syncleron has additional numerals.

Both FIG. 8 and FIG. 9 show the addition of the ordinal numbers 1st, 2nd, 3rd, 4th, 5th, 6th, 7th, 8th, 9th, 10th, 11th and 12th. These ordinal numbers are successively arranged around the edge of the sky-colored fixed outer circle with the ordinal numbers 1st and 12th associated with the dual horizon point where the fixed inner circle is tangent to the fixed outer circle. The ordinal numbers serve in the Synclecron invention as indicators of the successive hours of local solar day and local solar night being passed for a given day of the year at a given latitude and longitude in accord with the pre-modern notion of universal twelve-hour "natural" solar days and twelve-hour "natural" solar nights. Such ordinally-enumerated "natural" hours are those hours whose length during each given day and each given night vary based upon latitude and time of year. Such a view of twelve-hour-based solar days and nights are found in such ancient civilizations as Sumer, Egypt, Greece, Rome and China, and was also extant in Europe well beyond the time of the Middle Ages. In this pre-orthodox and post-modern way, the Synclecron presents to today's observers of time, an easy to grasp, visual display of Biblical horological references such phrases as "the third hour of the day", as well as seeing, and more vividly experienceng, the flow and ebb of natural time.

Figure 10:
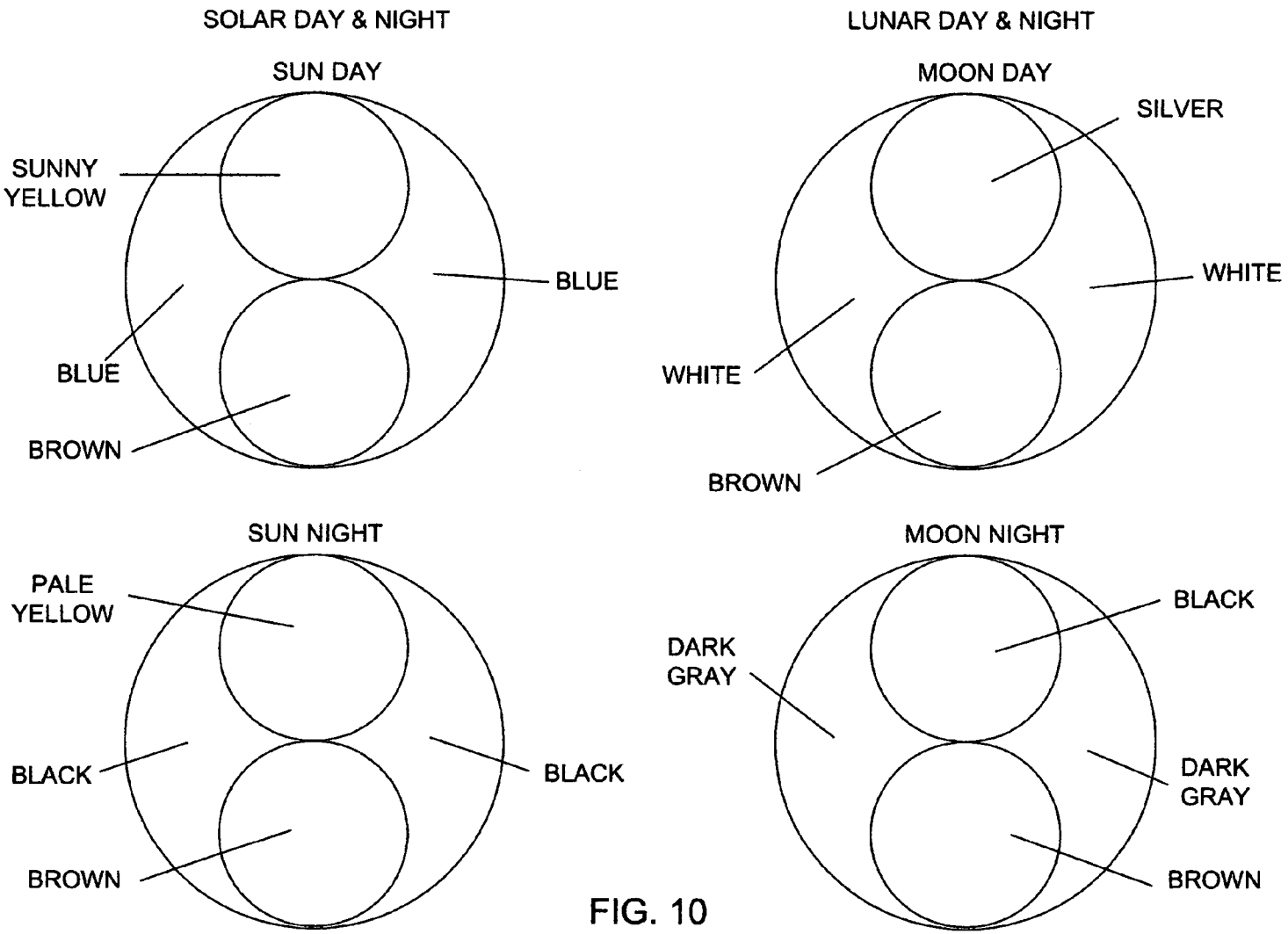
FIG. 10 is a diagram of Synclerons at different times.

FIG. 10 illustrates that the Synclecron invention can also be used to represent the flowing and ebbing passage of time of local lunar day and night, and the local days and nights of other astronomical bodies based on their local times of risings and settings. More specifically, FIG. 10 illustrates instances of the Synclecron invention displaying the passage of local solar day and night vs. the passage of local lunar day and night, in both cases using day and night hieroglyphs. In this illustration, the passages of local solar and local lunar day are above those of local solar and local lunar night, and the local solar and lunar cycles are side by side.

Figure 11B:
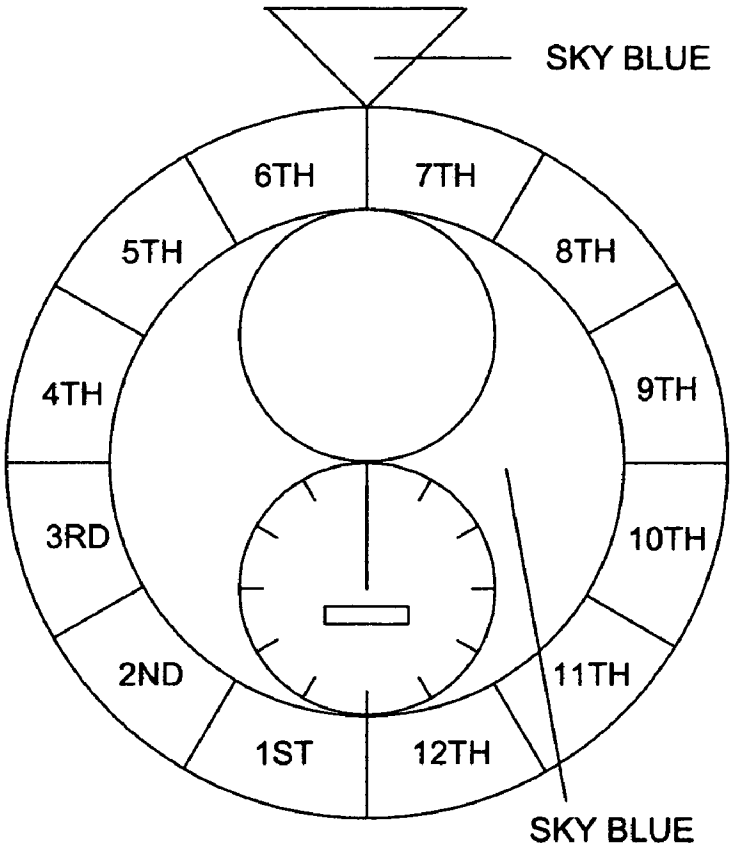
FIGS. 11*a* and 11*b* are diagrams of minute-hour indicators of the current invention.
Figure 11A:
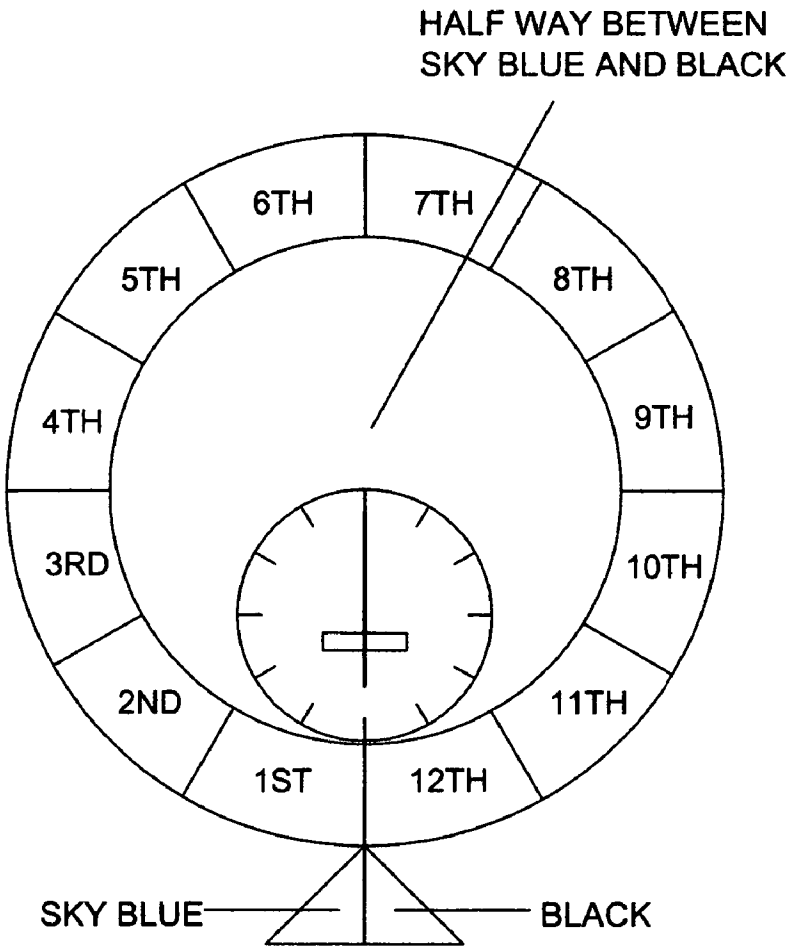

FIGS. 11*a* and FIG. 11*b* respectively illustrate the "minute-hour" indicator relative to the waxing and waning and moving local solar day hieroglyph at sunrise on a day when the sun locally rises at exactly 6 a.m., and when high noon locally occurs at exactly 12 noon standard time. In FIGS. 11*a* 11*b*, it is also illustrated that the various colors of the various hieroglyphs can be changed by the users of the Synclecron invention.

Figure 12A:
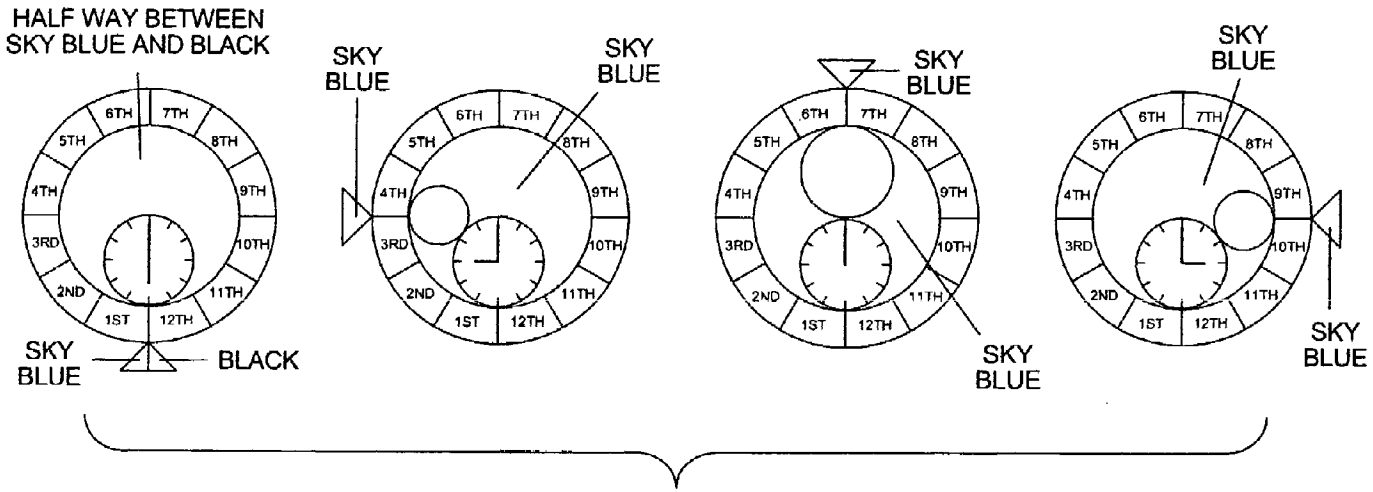
FIGS. 12*a* and 12*b* are diagrams of minute-hour indicators of the current invention shown at different times.
Figure 12B:
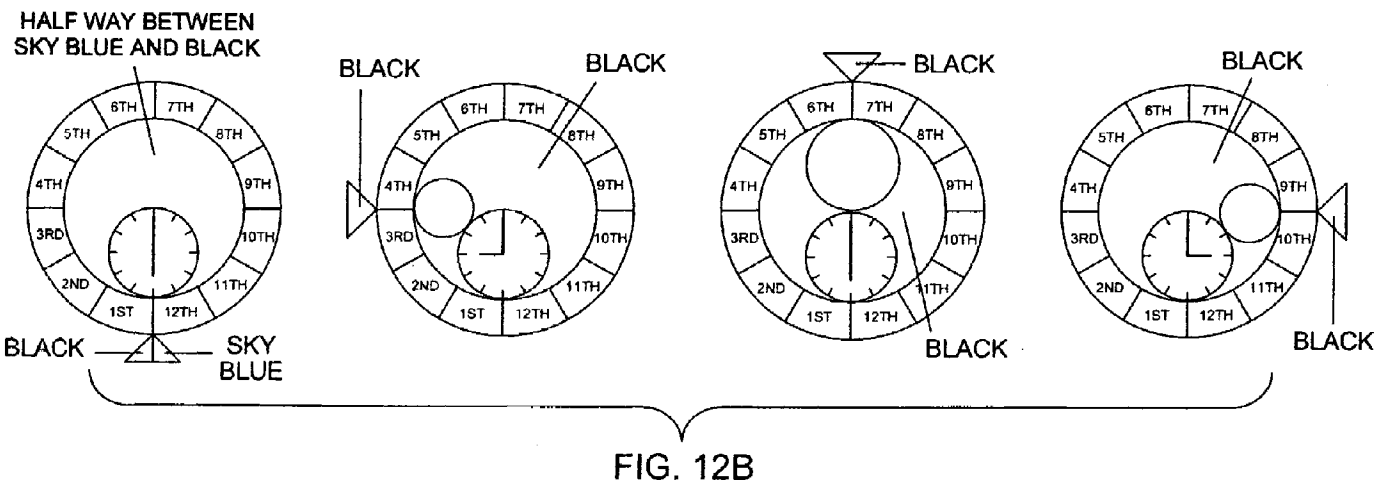

FIGS. 12*a*, and 12*b* respectively illustrate the "minute-hour" indicator relative to the waxing and waning local solar day and local solar night hieroglyphs at the beginning of the first, fourth hour, seventh and tenth "natural" hours of the day, and similar times of local solar night. These illustrations are for local solar days and local solar nights where sunrise and sunset are respectively 6 a.m. and 6 p.m.

FIGS. 12*a* and 12*b* also illustrate that the colors of the minute-hour indicator and the hieroglyphic sky can be synchronized and equalized. That is, as the minute-hour indicator rotates around the fixed outer circle passing from $1^{st}$ "natural" hour of the day to $2^{nd}$ and so forth, exactly at sunrise it can be, for example, half sky blue and half black. And then can become more sky blue and less black during the rest of the $1^{st}$ hour. And then it can be wholly sky blue until the last hour of the day, when and where it can begin to become more black and less sky blue. At exactly sunset and thus night rise, it can be half black and half sky blue. And it can become more and more black and less and less sky blue for the rest of the first hour of night. And then wholly black for the rest of the night, from the beginning of the second hour of night until an hour before sunrise of the next day. By choosing a color of the hieroglyphic sky that matches the color mix of the indicator during the Synclecron's daily and nightly cycles, a kind of natural dusk and dawn twilight can be represented as well as daily sky blue and nightly black skies.

Referring to FIGS. 8, 9, 10, 11 and 12, there are shown views of an apparatus incorporating features of the present Synclecron invention. Although the present invention has been described with reference to the several embodiments shown in drawings FIG. 8 and FIG. 9 and that of FIGS. 10, 11 and 12, it should be understood that the present invention can be embodied in many alternate forms. In addition, any suitable size or variation of elements or materials or colors could be used.

It should be further understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An apparatus configured to display a waxing and waning hieroglyph that twice each day of the rising and setting of an astronomical body journeys across a hieroglyphic sky around a hieroglyph earth in order to represent and display passages of local day and night of said astronomical body, for any given longitude and latitude, wherein the rates of change of each day's hourly passing and each night's hourly passing are adjusted according to the times of local rise and local set of said astronomical body for a given latitude and longitude location and that date, so that each day consists of twelve natural day hours and each night consists of twelve natural night hours, wherein a natural day hour is one twelfth of the time between that day's time of local rise and local set of said astronomical body, and a natural night hour is one twelfth of the time between that night's time of local set and the next day's time of local rise of said astronomical body.

2. The apparatus of claim 1, wherein said astronomical body is the sun or the moon.

3. The apparatus of claim 1, further comprising: a minute-hour indicator which by minutely rotating around an outer circle surrounding said waxing and waning hieroglyph as local day and night hourly progress indicates the portion of the natural hour of each local day or night currently occurring.

4. The apparatus of claim 3, further comprising:

a means for synchronizing and matching colors of said minute-hour indicator and said hieroglyphic sky so as to logically represent a dusk and dawn natural twilight as well as daytime and nighttime skies, as night turns into day around rise, and as day turns into night around set.

5. The apparatus of claim 1, further comprising:

a means of representing standard time that is a conventional analog or digital display.

6. The apparatus of claim 1, wherein in cases where the latitude is within a polar region, the invention displays passage of non-polar day and non-polar night for those parts of the year when non-polar day and non-polar night occur.

7. The apparatus of claim 1, wherein said hieroglyph comprises: a variable diameter inner circle that stays tangent to a fixed inner circle and also stays tangent to a fixed outer circle.

8. The apparatus of claim 7, wherein said inner circle of said hieroglyph waxes and wanes from a beginning point to an end point twice a day, the point being a point of tangency of the outer and inner fixed circles.

9. The apparatus of claim 8, wherein said variable diameter circle travels through the hieroglyphic sky area between the fixed inner circle and the fixed outer circle.

10. The apparatus of claim 9, wherein said variable diameter circle travels through the hieroglyphic sky area between the fixed inner circle and the fixed outer circle once during the course of the day and once during the course of the night.

11. The apparatus of claim 10, wherein timing of travel of said variable diameter circle through the hieroglyphic sky area between the fixed inner circle and the fixed outer circle is synchronized to passage of standard time.

12. The apparatus of claim 10, further comprising means for displaying standard time digital or analog format.

13. The apparatus of claim 10, wherein timing of travel of said variable diameter circle through the hieroglyphic sky area between the fixed inner circle and the fixed outer circle is synchronized to passage of natural night hours and natural day hours.

14. The apparatus of claim 1, further comprising: an analog digital display having a circle divided into twelve segments representing the twelve hours of natural day and natural night, wherein the segments are numbered from a first to a twelfth.

15. The apparatus of claim 14, further comprising: an indicator that orbits about the circle to a location representative of current natural time.

16. The apparatus of claim 15, wherein said indicator comprises a triangular shape with a vertex of said triangle pointing toward said circle.

17. The apparatus of claim 15, wherein said indicator changes color from a first color representing night to a second color representing day from the last natural hour of natural night through the first natural hour of natural day, and from said second color representing day to said first color representing night from the last natural hour of the natural day through the first natural hour of natural night.

18. The apparatus of claim 17, wherein said first color is black and said second color is blue.

19. The apparatus of claim 17, wherein said indicator is half said first color and half said second color at sunrise and at sunset.

20. The apparatus of claim 19, wherein a first half of said indicator is said first color at sunrise, and said same half is said second color at sunset.

21. An apparatus configured to display the synchronizing of a waxing and waning and twice-each-day journeying solar, lunar and other astronomical hieroglyphs and rotating minute-hour indicator to passages of conventional time, wherein local sunrise and sunset for each successive day of the year at each given longitude and latitude are represented and displayed twice each day hieroglyphically as a degenerate point circle point which coincides with the point of tangency between a fixed outer circle and a fixed inner circle of the apparatus, wherein the rates of change of each day's hourly passing of local solar day and each night's hourly passing of local solar night are adjusted according to the times of local sunrise and local sunset for a given latitude and longitude location and that date, so that each day consists of twelve natural daylight hours and each night consists of twelve natural night hours, wherein a natural day hour is one twelfth of the time between that day's time of local sunrise and local sunset, and a natural night hour is one twelfth of the time between that night's time of local sunset and the next day's time of local sunrise.

22. An apparatus configured to display the representation of a hieroglyphic display of the passage of local solar day and local solar night in terms of twelve natural hour days and twelve natural hour nights, with the lengths of each such hieroglyphically displayed natural hour of daytime and nighttime for each local solar day and night being respectively one twelfth of each daily and nightly cycle of the waxing and waning hieroglyph, and a means of simultaneously showing via digital or analog displays conventional flows of standard time, wherein the rates of change of each day's hourly passing of local solar day and each night's hourly passing of local solar night are adjusted according to the times of local sunrise and local sunset for a given latitude and longitude location and that date, so that each day consists of twelve natural daylight hours and each night consists of twelve natural night hours, wherein a natural day hour is one twelfth of the time between that day's time of local sunrise and local sunset, and a natural night hour is one twelfth of the time between that night's time of local sunset and the next day's time of local sunrise.

* * * * *